US006969812B2

(12) United States Patent
Shimizu et al.

(10) Patent No.: US 6,969,812 B2
(45) Date of Patent: Nov. 29, 2005

(54) SWITCH DEVICE

(75) Inventors: Keiichi Shimizu, Kasugai (JP); Yasuhide Tanaka, Owariasahi (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/652,784

(22) Filed: Aug. 29, 2003

(65) Prior Publication Data

US 2004/0045801 A1 Mar. 11, 2004

(30) Foreign Application Priority Data

Sep. 2, 2002 (JP) ..... 2002-256392

(51) Int. Cl.[7] ..... H01H 29/16
(52) U.S. Cl. ..... 200/200
(58) Field of Search ..... 200/1 B, 1 V, 5 R, 200/6 R, 17 R, 18, 553, 339, 200

(56) References Cited

U.S. PATENT DOCUMENTS 5,329,163 A * 7/1994 Satoh et al. ..... 307/10.1
5,557,080 A * 9/1996 Hayakawa ..... 200/5 R
5,601,183 A * 2/1997 Boyd et al. ..... 200/553
5,623,134 A * 4/1997 Hayakawa ..... 200/5 R
5,668,357 A * 9/1997 Takiguchi et al. ..... 200/5 R
5,672,854 A * 9/1997 Nishio ..... 200/16 R
5,902,972 A * 5/1999 Nestor et al. ..... 200/1 B
6,054,655 A * 4/2000 Rudolph et al. ..... 200/16 R
6,072,135 A * 6/2000 O'Connor ..... 200/345
6,097,105 A * 8/2000 Oikawa ..... 307/10.1
6,528,742 B2 * 3/2003 Serizawa et al. ..... 200/5 R
6,590,169 B2 * 7/2003 Martinez ..... 200/17 R
6,657,140 B2 * 12/2003 Rantet ..... 200/5 R
6,693,246 B1 * 2/2004 Rudolph et al. ..... 200/1 B
6,737,592 B1 * 5/2004 Hoang et al. ..... 200/1 B
6,774,329 B2 * 8/2004 Shimizu et al. ..... 200/339
6,800,825 B1 * 10/2004 Sasaki et al. ..... 200/402

* cited by examiner

*Primary Examiner*—Lisa N. Klaus
(74) *Attorney, Agent, or Firm*—Beyer Weaver & Thomas LLP

(57) ABSTRACT

A switch device for rotating and stopping a DC motor includes a first switch element having two moving contacts, two normally open NO contacts and two normally closed NC contacts, a second switch element having one or two normally closed NC contacts, and an operating element. The operating element serves to connect the two moving contacts individually to input terminals of the DC motor, the two NO contacts to a voltage source line at a higher voltage, and each of the two NC contacts of the first switch element to another voltage source line at a lower voltage such as the ground potential, each through the NC contact, or one of the two NC contacts, of the second switch element. The NC contact of the second switch element is maintained in an open condition during a period from when either one of the NO contacts begins to change from a closed condition to an open condition until the corresponding NC contact of the first switch element finishes changing from an open condition to a closed condition.

7 Claims, 11 Drawing Sheets

SWITCH DEVICE

BACKGROUND OF THE INVENTION

This invention relates to a switch device for starting and stopping the rotation of a DC electric motor for opening and closing a window of a motor vehicle such as an automobile or for a similar purpose and more particularly to such a switch device for a DC electric motor operating at a high source voltage (such as 42V).

Automobiles currently make use of a 14V electrical system with source voltage of 12V. Since an increased number of electronic devices are being carried on automobiles, however, a 14V system is sometimes hardly capable of supplying sufficient power. As a result of global discussions in consortia representing both universities and industries in view of this problem, a consensus has been obtained from the point of view of safety to human bodies to adopt a voltage system that is three times higher, or a 42V system with source voltage of 36V. Examples of electrical equipment to be operated in a 42V electrical system include DC motors contained in a door for opening and closing a window (or so-called DC motors for operating a power window).

FIGS. 10A and 10B are respectively a structural diagram and a circuit diagram of a prior art switch device 1 for rotating (both in positive and negative directions) and stopping such a DC motor 2 for operating a power window. Such a switch device may typically be installed inside the elbow rest attached to the front or back seat of the vehicle or inside a door. FIGS. 10A and 10B show the switch device 1 when the DC motor 2 is stopped, that is, when a knob 3 therefor is not being operated. In what follows, this condition is referred to as the neutral condition.

The knob 3 is attached to a case 4 on a door such that it can be tilted by a specified angle both in clockwise and counter-clockwise directions, as shown in FIG. 10A. If the knob 3 is rotated in the clockwise direction, the window is closed (to be in the UP condition). If the knob 3 is rotated in the counter-clockwise direction, the window is opened (to be in the DOWN condition). If the force applied on the knob 3 is released, or if the finger is lifted therefrom, the knob 3 returns to its neutral position by the operations of a spring 5 and a plunger 6 buried inside the knob 3 and thereafter remains in this neutral condition.

The knob 3 has a downward protrusion 7 which is at a position as shown in FIG. 10A when the knob 3 is in the neutral position but swings to the left when the knob 3 is in the UP condition as shown in FIG. 12A and to the right when the knob 3 is in the DOWN condition (not shown in drawing).

Provided inside the case 4 is a switch unit 9 mounted to a printed circuit board 8 so as to function as a two-circuit two-contact switch of a momentary type. FIG. 11 shows an external view of this switch unit 9, comprising a housing 10, two common terminals 11 and 12 coming out of one side surface of the housing 10, one normally open terminal 13 coming out of the other side surface of the housing 10 and two normally closed terminals 14 and 15 coming out of the bottom surface of the housing 10. These terminals 11–15 are soldered to specified conductor circuits on the printed circuit board 8 so as to be connected to a power source line (or the +B line) 17, a grounding line 18 and the DC motor 2, as shown in FIG. 10B.

As shown in FIG. 10B, the switch unit 9 includes two switch mechanisms A and B adapted to operate mutually exclusively according to the position of a slider 28 on the upper surface of the switch unit 9. In the above, to be switched mutually exclusively means opening only the normally closed (NC) contact of either one of the switch mechanisms A and B, or closing only the normally open (NO) contact of that switch mechanism.

Explained more in detail, when the slider 28 is in the neutral condition, as shown in FIG. 10A, it is in the closed condition between the moving contact 19 and the NC contact 23 of the first switch mechanism A and between the moving contact 20 and the NC contact 24 of the second switch mechanism B. In this position, the NO contacts 21 and 22 of both switch mechanisms A and B are in open condition and the NC contacts 23 and 24 of both switch mechanisms A and B are in closed condition, as their names (NO and NC) indicate. If the slider 28 is moved to the left as indicated by arrow L in FIG. 11 to be in the UP condition, the closed condition between the moving contact 20 and the NC contact 24 of the second switch mechanism B is maintained but the NC contact 23 of the first switch mechanism A is released from the closed condition and a new closed condition is established between the moving contact 19 and the NO contact 21. Likewise, if the slider 28 is moved to the right as indicated by arrow R in FIG. 11 to be in the DOWN condition, the closed condition between the moving contact 19 and the NC contact 23 of the first switch mechanism A is maintained but the NC contact 24 of the second switch mechanism B is released from the closed condition and a new closed condition is established between the moving contact 20 and the NO contact 22.

The switching operations as described above are made possible by the movement of the slider 28 as well as by the designed shape of the bottom surface of the slider 28. FIGS. 11C and 11D are sectional views of the slider 28 taken respectively along lines 11C—11C and 11D and 11D of FIG. 11B. FIG. 11C shows that the right-hand half of the slider 28 is made thicker and FIG. 11D shows that the left-hand half of the slider 28 is made thicker. As will be explained below, the switching mechanisms A and B are switched in a mutually exclusive manner according to the positional relationship between these thickly made portions of the slider 28. It is to be noted that only one of the common terminals 11 and 12 and one of the normally closed terminals 14 and 15 are visible in FIG. 10A because the others of the common terminals and the normally closed terminals are hidden behind the front ones.

As explained above, the switch unit 9 described above functions as a two-circuit two-contact switch of a momentary type. This comes about because the moving contacts 19 and 20, the NO contacts 21 and 22 and the NC contacts 23 and 24 are connected respectively to the common terminals 11 and 12, the normally open terminal 13 and the normally closed terminals 14 and 15 such that the switching of contacts in two circuits (that is, the switching between the NO contact 21 and the NC contact 23 by the moving contact 19 and the switching between the NO contact 22 and the NC contact 24 by the moving contact 20) can be effected in a mutually exclusive manner.

The moving contacts 19 and 20 are attached at the tips of a mobile pieces 25 and 26 each in the form of a metallic spring plate, and these mobile pieces 25 and 26 are biased downwardly with reference to FIG. 10A by means of push buttons 27A (for the first switch mechanism A) and 27B (for the second switch mechanism B). These push buttons 27A and 27B are in contact with the bottom surface of the slider 28 and are individually pushed downward if the slider 28 is moved to the left as shown in FIG. 12A according to the contour (or the position of the thick portions) of the slider 28. The slider 28 has an upward protrusion 29 that engages with the tip of the downward protrusion 7 of the knob 3 and slides in the left-right direction according to the movement of the knob 3 into the UP and DOWN conditions.

In other words, as the knob 13 of this switch device 1 is raised into the UP condition, the slider 28 slides to the left and the push button 27A in contact with its thick portion along line 11C—11C is pushed downward, thereby establishing an open condition between the moving contact 19 and the NC contact 23 of the first switch mechanism A while maintaining a closed condition between the moving contact 19 and the NO contact 21.

If the finger is released from the knob 3 to set it in its neutral condition, the slider 28 slides to the right to return to its original position, causing the push button 27A to move upward and the moving contact 19 and the NC contact 23 of the first switch mechanism A to be in the closed condition.

If the knob 3 is pushed down to set it in the DOWN condition, the slider 28 slides to the right and the push button 27B in contact with its thick portion along line 11D—11D is pushed downward, thereby establishing an open condition between the moving contact 20 and the NC contact 24 of the second switch mechanism B while maintaining a closed condition between the moving contact 20 and the NO contact 22. If the finger is released from the knob 3 thereafter to set it in its neutral condition, the slider 28 slides to the left to its original position, causing the push button 27B to move upward and the moving contact 20 and the NC contact 24 of the second switch mechanism B to be in the closed condition.

When the knob 3 is in the neutral condition, the contacts of the first and second switch mechanisms A and B are in conditions as shown in FIG. 10B, that is, the moving contact 19 and the NC contact 23 of the first switch mechanism A are in the closed condition and the moving contact 20 and the NC contact 24 of the second switch mechanism B are in the closed condition. Under this condition, the DC motor 2 is not connected to the +B line 17 and hence the DC motor 2 does not rotate.

When the knob 3 is in the UP condition, the contacts of the first and second switch mechanisms A and B are in conditions as shown in FIG. 12B, that is, the moving contact 19 and the NO contact 21 of the first mechanism A are in the closed condition and the moving contact 20 and the NC contact 24 of the second switch mechanism B are in the closed condition. Under this condition, a closed circuit is formed from the +B line 17 to the DC motor 2 to the grounding line 18, and the DC motor 2 rotates in the direction of closing the window.

If the knob 3 is in the DOWN condition, although not shown, the moving contact 19 and the NC contact 23 of the first switch mechanism A are closed and the moving contact 20 and the NO contact 22 of the second switch mechanism B are closed. Under this condition, a closed circuit is formed from the grounding line 18 to the DC motor 2 to the +B line 17, and the DC motor 2 rotates in the direction of opening the window.

Although an example has been explained wherein the rotation of a DC motor is controlled by a single switch unit, there are also switch devices, depending on the kind of automobiles, allowing the window on the rider's side or the back windows to be controlled from the driver's seat. FIG. 13 shows a circuit structure for such a switch device, structured as a combination of a switch unit 9 for the driver and another switch unit 9' for the rider such that the DC motor 2 for the window on the rider's side can be rotated or stopped not only by the rider but also by the driver.

Although an example was described above wherein a single terminal is assigned to each of the moving contacts 19 and 20 and the NC contacts 23 and 24 (that is, the common terminals 11 and 12 and the normally closed terminals 14 and 15) and a single normally open terminal 13 is assigned to both NO contacts 21 and 22 such that there are altogether five terminals, there are examples of other types such as shown in FIG. 14. The example shown in FIG. 14 is characterized wherein contacts connected to the grounding line 18 (the NC contacts 23 and 24 of the first and second switch mechanisms A and B) are connected together inside the unit and then pulled out from a single terminal 15*a* to be connected to the grounding line 18 such that there are altogether four terminals. Alternatively, two switch mechanisms each with one circuit may be used. In such a case, there are six terminals altogether.

Examples of prior art switch system described above with reference to FIGS. 10–14 may all be used without any trouble as long as they are used with a conventional 14V electrical system. If such a prior art switch system is used with a 42V electrical system, however, an overly strong current will flow between a specified pair of contacts at the return time from the UP condition to the neutral condition or from the DOWN condition to the neutral condition, thereby damaging these contacts.

FIG. 15 shows how such a damage may come about, FIG. 15A showing the switch device in the UP condition, FIG. 15B showing it at a moment immediately before its return to the neutral condition, and FIG. 15C showing when the switch device has returned to the neutral condition. They are different from the diagrams explaining the prior art operations in that a higher voltage (the source voltage of a 42V electrical system being 36V) is being applied to the +B line 17.

When the mechanism is in the UP condition as shown in FIG. 15A, the NO contact 21 and the moving contact 19 of the first switch mechanism A are in the closed condition and the moving contact 20 and the NC contact 24 of the second switch mechanism B are similarly in the closed condition. As a result, a closed circuit is formed from the +B line 17 to the DC motor 2 to the grounding line 18 and the DC motor 2 rotates in the direction of closing the window. When the driver's finger is released from the knob 3, the NO contact 21 and the moving contact 19 of the first switch mechanism A are released from their closed condition and the moving contact 19 begins to move towards the NC contact 23 while generating small arc discharges between the NO contact 21 within an allowable range until finally the moving contact 19 and the NC contact 23 of the first switch mechanism A come to be in the closed condition as shown in FIG. 15C. The source voltage then ceases to be supplied to the DC motor 2 and the rotation of the DC motor 2 stops.

In the case of a prior art switch device, the contact gap is as small as about 0.5 mm and hence cannot support an arc discharge voltage of about 42V. Thus, the moving contact 19 is in the condition of having a voltage of several volts applied thereto when it becomes connected to the NC contact 23. By experiments carried out by the present inventors, it was discovered that a large current of over 100A will flow from the moving contact 19 to the grounding line 18 through the NC contact 23 over a very short period of time such as about 0.5 ms (as indicated by a thick arrow 31 in FIG. 15C and that this results in a large discharge (indicated by numeral 32) between the NO contact 21 and the NC contact 23, thereby damaging or destroying the moving contact 19 and the NC contact 23.

Since this phenomenon will impede the popular acceptance of 42V electrical systems, its elimination has been a technical problem to be solved as quickly as possible.

In general, the gap between contacts is made wider as the applied voltage is increased in order to prevent arc discharges. If the gap is increased to about 4 mm, the arc discharge voltage may be accordingly increased and the moving contact 19 can be connected to the NC contact 23 while no voltage is applied thereon. If the gap is thus increased, however, the switch unit as a whole becomes large and may be inconvenient for being used on a vehicle.

SUMMARY OF THE INVENTION

It is therefore an object of this invention to provide a switch device which will not cause the switch unit to become large when applied to a 42V electrical system, while being able to prevent damages to the contacts and causing no increase in the time lag in switching between contacts.

A switch device according to a first embodiment of this invention for rotating and stopping a DC motor may be characterized as comprising a first switch element, a second switch element and an operating element, the first switch element having two moving contacts, two normally open NO contacts and two normally closed NC contacts, the second switch element having at least one (say, one or two) normally closed NC contact, and the operating element serving to make connections in specified manners such as connecting the two moving contacts of the first switch element individually to input terminals of the DC motor, connecting the two NO contacts to a voltage source line ("the higher voltage source line), and connecting each of the two NC contacts of the first switch element to another voltage source line ("the lower voltage source line") at a lower voltage than the higher voltage source line each through one of the at least one NC contact of the second switch element. The operating element further serves to maintain the aforementioned at least one NC contact of the second switch element in an open condition during a period from when the NO contacts begin to change from a closed condition to an open condition until the NC contacts of the first switch element finish changing from an open condition to a closed condition.

With a switch device thus structured, the DC motor stops its rotation if the two NC contacts of the first switch element are set in the closed condition because the lower voltage of the lower source line (say, at the ground voltage) is then applied to both of the input terminals of the DC motor through these two NC contacts of the first switch element and the NC contact or contacts of the second switch element. If either one of the two NC contacts of the first switch element alone is set in the closed condition, the DC motor rotates because while the lower voltage source line is connected to one of the input terminals of the DC motor through this closed NC contact of the first switch element and the NC contact of the second switch element (if the second switch element has only one NC contact) or the corresponding one of the NC contacts of the second switch element (if the second switch element has two NC contacts) connected to the closed NC contact of the first switch element, the higher voltage source line is connected to the other of the input terminals of the DC motor through the closed one of the two NO contacts of the first switch element.

If the closed one of the two NO contacts of the first switch element is returned to its normally open condition while the DC motor is rotating as explained above, the DC motor stops its rotation. In this situation, during the period from the starting moment when the closed NO contact of the first switch element begins to be opened until the corresponding NC contact completes its change from the open condition to the closed position, the corresponding NC contact of the second switch element is maintained in the open condition such that the current route between the NC contacts of the first switch element and the lower voltage source line and hence no large instantaneous current can be generated and damage to the contacts of the first switch element can be prevented.

A switch device according to a second embodiment of the invention is similar to the one according to the first embodiment described above except that the operating element serves to connect the two NC contacts of the first switch element to the lower voltage source line and each of the two NO contacts of the first switch element to the higher voltage source through the NC contact or one of the NC contacts of the second switch element. Moreover, before either one of the NO contacts of the first switch element changes from a closed condition to an open condition, the operating element allows the normally closed NC contact of the second switch element connected to the opened NO contact to be in an open condition.

With a switch device thus structured, the DC motor stops its rotation if the two NC contacts of the first switch element are set in the closed condition because the lower voltage source line is then connected to both of the input terminals of the DC motor through these two NC contacts of the first switch element. If either one of the two NC contacts of the first switch element alone is set in the closed condition, the DC motor rotates because while the lower voltage source line is connected to one of the input terminals of the DC motor through this closed NC contact of the first switch element, the higher voltage source line is connected to the other of the input terminals of the DC motor through the closed one of the two NO contacts of the first switch element and the NC contact of the second switch element (if the second switch element has only one NC contact) or the corresponding one of the NC contacts of the second switch element (if the second switch element has two NC contacts) connected to the closed NC contact of the first switch element.

If the closed one of the two NO contacts of the first switch element is returned to its normally open condition while the DC motor is rotating as explained above, the DC motor stops its rotation. In this situation, before the closed one of the NO contacts of the first switch element changes from a closed condition to an open condition, the corresponding NC contact of the second switch element is allowed (say, by a manual operation) to be in an open condition such that the current route between the NO contacts of the first switch element and the higher voltage source line and hence no large instantaneous current can be generated and damage to the contacts of the first switch element can be prevented.

A switch device according to a third embodiment of this invention may be characterized also as comprising a first switch element, a second element and an operating element. The first element has two normally open NO contacts and the second switch element has two normally closed NC contacts. The operating element serves to connect the two input terminals of a DC motor to the higher voltage line each through a corresponding one of the two NO contacts of the first switch element and the two input terminals of the DC motor to the lower voltage source line through a corresponding one of the two NC contacts of the second switch element. Before either one of the NO contacts of the first switch element changes from an open condition to a closed condition, the operating element allows the NC contact of the second switch element connected to the closed NO contact to be in an open condition.

With a switch device thus structured, the DC motor stops its rotation if the two NO contacts of the first switch element are set in the open condition and the two NC contacts of the second switch element are set in the closed condition because the lower voltage source line is then connected to both of the input terminals of the DC motor through the two NC contacts of the second switch element. If either one of the two NO contacts of the first switch element alone is set in the closed condition and the NC contact of the second switch element connected to the corresponding NC contact is opened, the DC motor rotates because while the lower voltage source line is connected to one of the input terminals of the DC motor through these closed contacts, the higher voltage source line is connected to the other of the input terminals of the DC motor.

If the closed one of the two NO contacts of the first switch element is returned to its normally open condition while the DC motor is rotating as explained above and the corresponding NC contact of the second switch element is returned to its closed condition, the DC motor stops its rotation. In this situation, before the closed one of the NO contacts of the first switch element changes from a closed condition to an open condition, the corresponding NC contact of the second switch element is allowed to be returned to the closed condition such that the NO contacts of the first switch element can support a sufficiently large voltage for an arc discharge and the generation of a large instantaneous current can be prevented although the NC contact connected to this NO contact of the first switch element becomes closed and hence damage to the contacts of the first switch element can be prevented.

BRIEF DESCRIPTION OF THE DRAWINGS

Throughout herein, components that are equivalent or at least similar may be indicated by the same symbols and may not necessarily be explained or described in a repetitious manner.

DETAILED DESCRIPTION OF THE INVENTION

Figure 1:
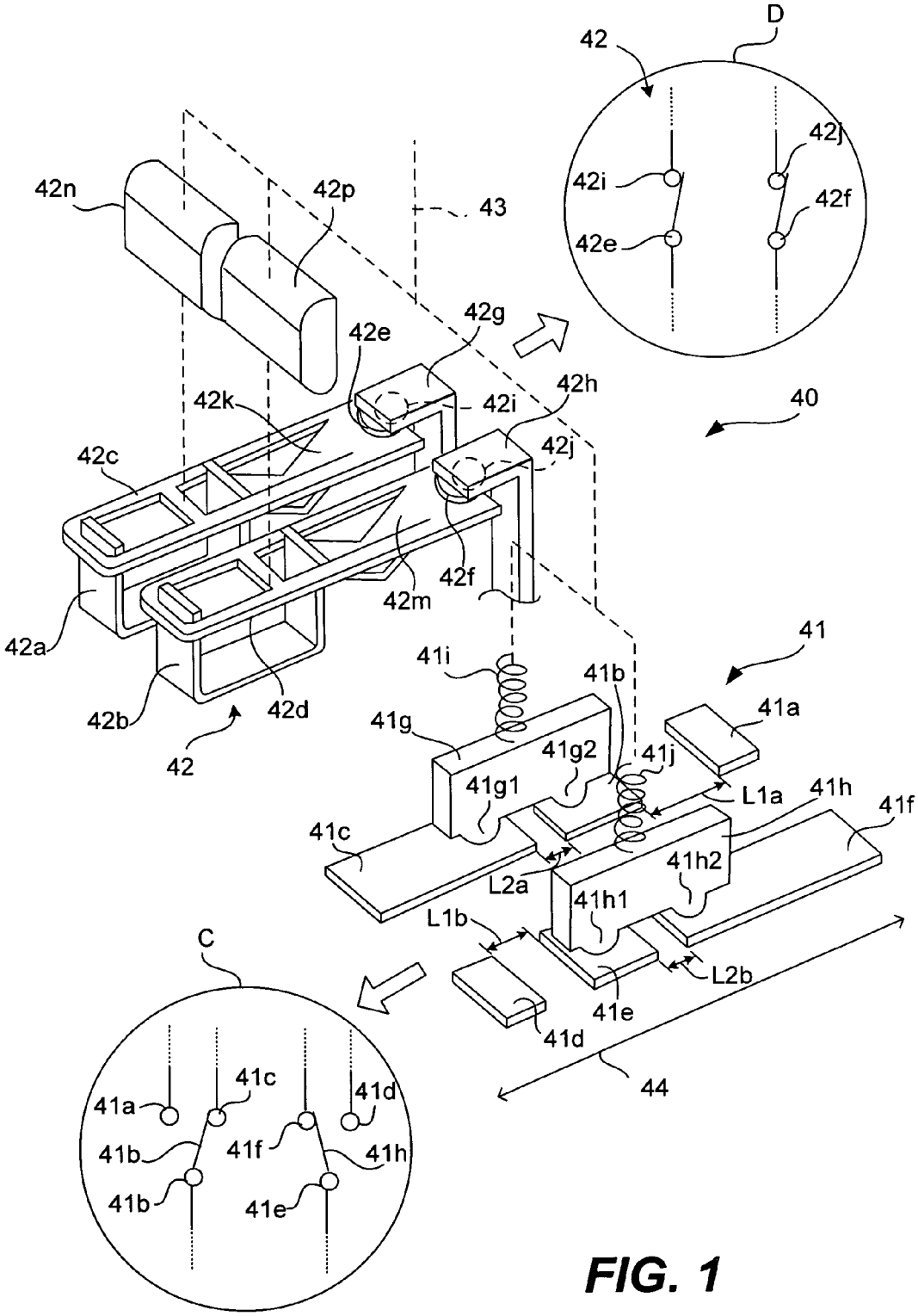
FIG. 1 is a structural diagram of a switch device embodying this invention.

The invention is described next by way of examples. FIG. 1 shows a switch device 40 according to a first embodiment of this invention, which may be roughly characterized as comprising two switch elements (the first switch element 41 and the second switch element 42) and an operating element 43 for carrying out the switching operations of these two switch elements 41 and 42.

Next, each of these elements will be described individually. The first switch element 41 is comprised of six fixed electrodes 41*a*–41*f* each made of a planar metallic conductor inserted inside a molded base (not shown) or formed as a thin film and two mobile members 41*g* and 41*h*. The metallic material for these six fixed electrodes has a high electrical conductivity and is strong against wears such as copper, bronze and alloys of copper and iron. These six fixed electrodes are arranged in two group of three each, the first group consisting of electrodes 41*a*, 41*b* and 41*c* and the second group consisting of electrodes 41*d*, 41*e* and 41*f*. The two groups of fixed electrodes are arranged parallel to each other, as shown in FIG. 1.

Let D41*a*, D41*b*, D41*c*, D41*d*, D41*e* and D41*f* denote respectively the surface areas of the fixed electrodes 41*a*, 41*b*, 41*c*, 41*d*, 41*e* and 41*f*. Then, they are related as follows: D41*a*=D41*d*, D41*b*=D41*e* and D41*c*=D41*f*. The fixed electrodes 41*a*, 41*b* and 41*c* of the first group are arranged in this order in the direction shown by line 44 from right to left with reference to FIG. 1. The fixed electrodes 41*d*, 41*e* and 41*f* of the second group are arranged in this order along the same line from left to right with reference to FIG. 1. The separation L1*a* between the fixed electrodes 41*a* and 41*b* is greater than the separation L2*a* between the fixed electrodes 41*b* and 41*c*. Similarly, the separation L1*b* (=L1*a*) between the fixed electrodes 41*d* and 41*e* is greater than the separation L2*b* (=L2*a*) between the fixed electrodes 41*e* and 41*f*.

The mobile members 41*g* and 41*h* are shaped so as to be slidable in the direction of the line 44 respectively over the first and second groups of the fixed electrodes 41*a*–41*c* and 41*d*–41*f*. For example, each may have two curved downward protrusions (the mobile member 41*g* having protrusions 41*g*1 and 41*g*2, and the mobile member 41*h* having protrusions 41*h*1 and 41*h*2). Each may be made of a metallic material such as copper, bronze and alloys of copper and iron with a high electrical conductivity and strong against frictional wears.

The mobile members 41*g* and 41*h* are downwardly biased by means respectively of springs 41*i* and 41*j* such that their protrusions are pressed respectively against the fixed electrodes 41*a*–41*c* and 41*d*–41*f* of the first and second groups. The separation between the two protrusions on each of the mobile members 41*g* and 41*h* is so set as to be greater than L1*a* (=L1*b*). Explained for the mobile member 41*g* (because the other mobile member 41*h* is similar), for example, the separation between its protrusions 41g1 and 41g2 is determined such that they can contact only the fixed electrodes 41a and 41b of the first group to connect their metallic conductors and also only the fixed electrodes 41b and 41c of the first group to connect their metallic conductors.

It may be reminded at this point that these mobile members 41g and 41h need not be made entirely of a metallic material of a high conductivity and strong against frictional wears. What is essential is that each be capable of moving in the direction of the line 44 so as to contact only the fixed electrodes 41a and 41b of the first group (in the case of mobile member 41g) to connect their metallic conductors and also only the fixed electrodes 41b and 41c to connect their metallic conductors. Thus, it is sufficient for this purpose if the two protrusions on each of the mobile members 41g and 41h are made of a friction-resistant metallic material with a high conductivity either entirely or on the contacting surfaces and if these two protrusions are electrically connected.

The two mobile members 41g and 41h are adapted to move to left and right in the direction of the line 44 while remaining parallel to each other as shown in FIG. 1 by the operation of the aforementioned operating element 43.

With the first switch element 41 thus structured as explained above, if its two mobile members 41g and 41g are in their neutral positions as shown in FIG. 1, the protrusions 41g1 and 41g2 of the mobile member 41g contact the fixed electrodes 41b and 41c of the first group to connect their conductors together in a closed condition and the protrusions 41h1 and 41h2 of the other mobile member 41h contact the fixed electrodes 41e and 41f to connect their conductors together in a closed condition. In other words, the fixed electrodes 41a and 41b of the first group and the fixed electrodes 41d and 41e of the second group can be kept in an open condition with respect to each other.

If the mobile member 41g is moved from the neutral position to right with reference to FIG. 1, its protrusions 41g1 and 41g2 come to contact the fixed electrodes 41a and 41b of the first group to connect their conductors in a closed condition. In this situation, the fixed electrodes 41b and 41c are switched into an open condition. At the same time, the other mobile member 41h is caused to move from its neutral position to right with reference to FIG. 1 but its protrusions 41h 1 and 41h2 keep the fixed electrodes 41f and 41e of the second group in the closed condition.

Similarly, when the mobile member 41h is moved from its neutral position to left with reference to FIG. 1, its protrusions 41h1 and 41h2 come to contact the fixed electrodes 41d and 41e of the second group to connect their conductors in a closed condition. In this situation, the fixed electrodes 41e and 41f of the second group are switched into an open condition. At the same time, the other mobile member 41g is caused to move from its neutral position to left with reference to FIG. 1 but its protrusions 41g1 and 41g2 keep the fixed electrodes 41c and 41b of the first group in the closed condition.

Circle portion C of FIG. 1 shows the circuit structure of the first switch element 41. In this circuit diagram, the mobile members 41g and 41h and the fixed electrodes 41b and 41e correspond to the two moving contacts described above in the Background section. The fixed electrodes 41a and 41d correspond to the NO contacts and the fixed electrodes 41c and 41f correspond to the NC contacts.

When the mobile members 41g and 41h are in their neutral positions as shown in FIG. 1, the NC contacts (41c and 41f) are in the closed condition. If the mobile member 41g moves from its neutral position to right along the line 44, the NC contact 41c is released from its closed condition and the NO contact 41a comes to be in the closed condition. If the other mobile member 41h moves to left from its neutral position along the line 44, the NC contact 41f is released from its closed condition and the NO contact 41d comes to be in the closed condition.

In summary, this first switch element 41 functions like a switch of a two-circuit, four-contact type. If the centering positions of the mobile members 41g and 41h is adjusted to the aforementioned neutral positions shown in Table 1 by means of the operating element 43 to be described below, two (41c and 41f) of the four fixed electrodes 41a, 41c, 41d and 41f on both sides of this neutral position become the NC contacts and the remaining two (41a and 41d) become the NO contacts.

The second switch element 42 is formed on the same base board (not shown) on which is formed the first switch element 41 by mounting thereon two switch mechanisms of the same structure to be described below.

Explained more in detail, the second switch element 42 is comprised of U-shaped members 42a and 42b set on the aforementioned base board, mobile members 42c and 42d each in the form of a metallic plate spring and having one end supported by a corresponding one of the U-shaped members 42a and 42b, moving contacts 42e and 42f attached to the other ends of the mobile members 42c and 42d, reverse L-shaped members 42g and 42h set on the base board and fixed contacts 42i and 42j set on the downwardly facing end parts of the reverse L-shaped members 42g and 42h.

The metallic plate spring-like mobile members 42c and 42d have cutout portions 42k and 42m which are bent so as to contact the U-shaped members 42a and 42b. The elastic returning force of these cutout portions 42k and 42m is utilized so as to normally keep the moving contacts 42e and 42f on the other ends in contact with the fixed contacts 42i and 42j in closed conditions. Thus, the fixed contacts 42i and 42j function as normally closed (NC) contacts.

If a downward external force in excess of the elastic returning force of the cutout portions 42k and 42m is applied to the mobile members 42c or 42d through a corresponding one of push buttons 42n and 42p which are individually provided, the tip portions of the mobile members 42c and 42d move downward and the closed conditions between the moving contacts 42e and 42f and the fixed contacts 42i and 42j are released and open conditions are set between these contacts.

Circle portion D of FIG. 1 shows the circuit structure of the second switch element 42. In this circuit diagram, the two moving contacts 42e and 42f are in closed condition respectively with the fixed contacts (NC contacts) 42i and 42j. If a downward external force is applied to the mobile member 42c, the closed condition between the moving contact 42e and the fixed contact (NC contact) 42i is released and they come to be in the open condition. Similarly, if a downward external force is applied to the other mobile member 42d, the closed condition between the moving contact 42f and the fixed contact (NC contact) 42j is released and they come to be in the open condition.

In summary, this second switch element 42 functions like a switch of the two-circuit, two-contact type, having a pair of NC contacts (42i and 42j).

The aforementioned operating element 43 is indicated by broken lines in FIG. 1 for the convenience of disclosure and is characterized as having the following four functions: (1) the function of maintaining the first and second switch elements 41 and 42 in the neutral positions as shown in FIG.

1 if there is no input from the operator (such as the operation on the knob 13 to the UP or DOWN condition as explained above); (2) the function of returning the first and second switch elements 41 and 42 to their neutral positions as soon as an input operation by the operator is released; (3) the function of moving one of the mobile members (such as the member 41*h*) of the first switch element 41 from the neutral position along the line 44 in one direction (such as to left with reference to FIG. 1) and setting one of the NC contacts (such as the fixed contact 42*j*) of the second switch element 42 in the open condition in response to an operation of the operator (such as the UP operation); and (4) the function of moving the other of the mobile members (such as the member 41 g) of the first switch element 41 from the neutral position along the line 44 in the other direction (such as to right with reference to FIG. 1) and setting the other of the NC contacts (such as the fixed contact 42*i*) of the second switch element 42.

Figure 2:
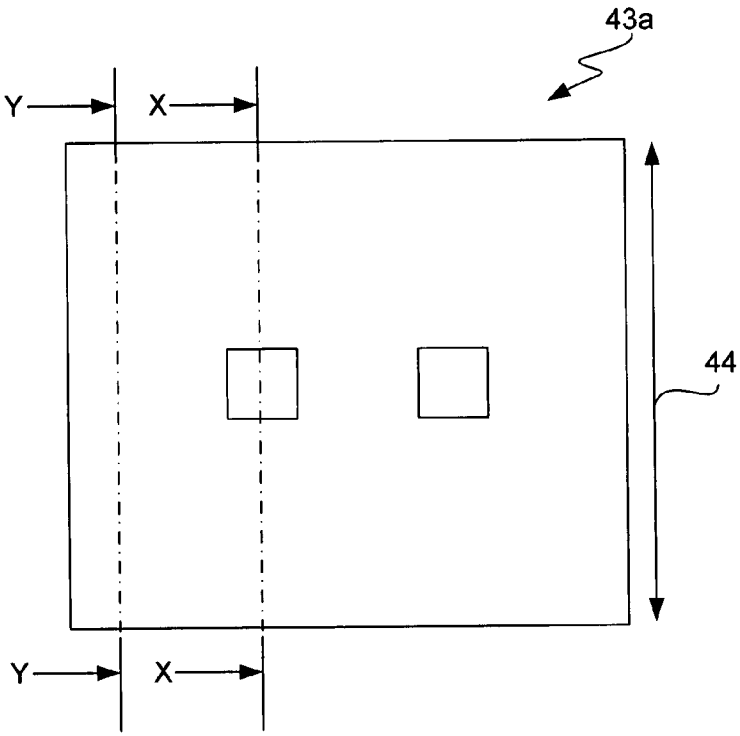
FIG. 2 is a plan view of a slider as the operating element of the switch device of FIG. 1.
Figure 3:
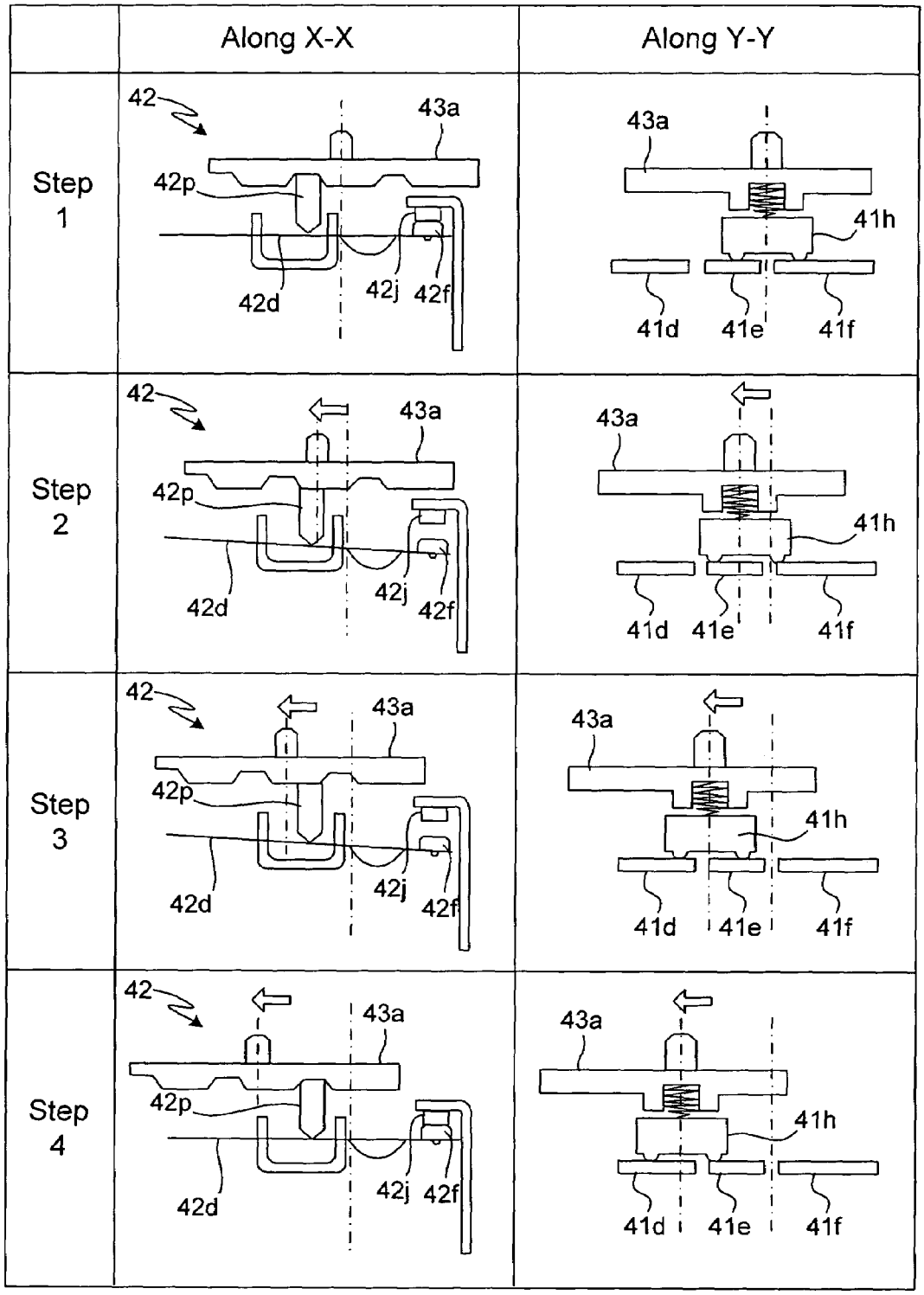
FIG. 3 is a diagram for showing the operation of one of switch groups.
Figure 10A:
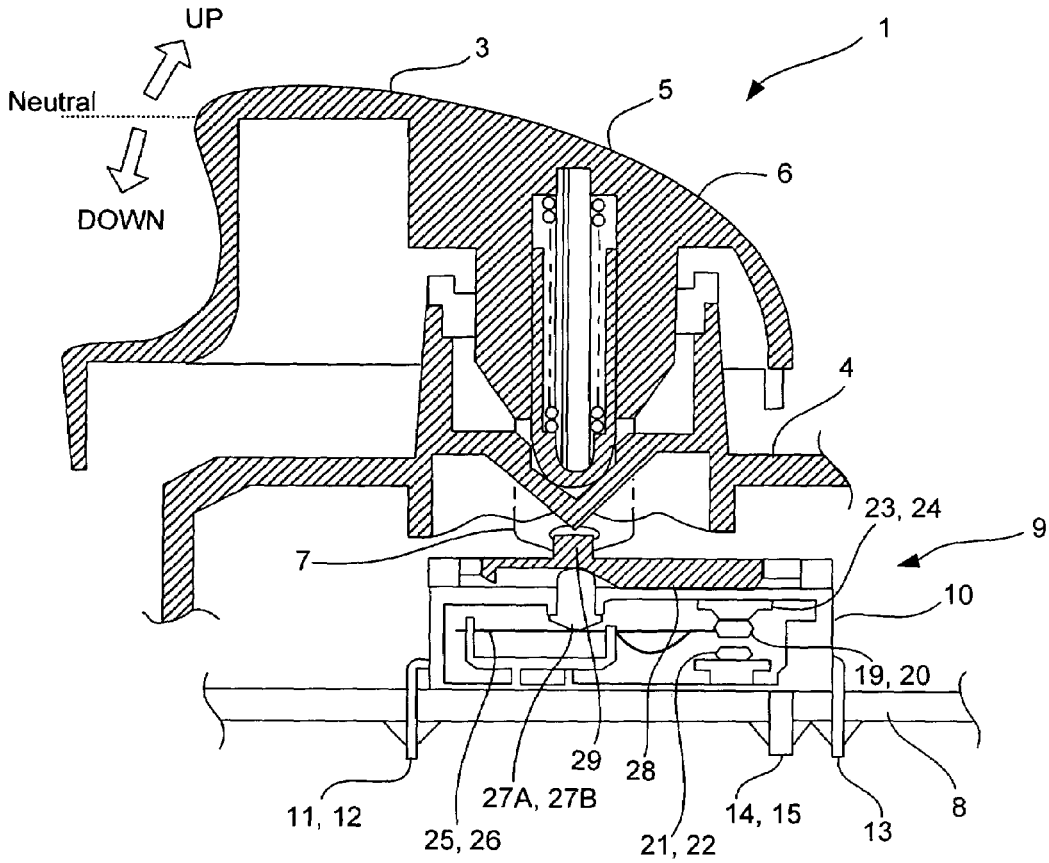
FIG. 10A (PRIOR ART)
FIGS. 10A and 10B, together referred to as FIG. 10, are respectively a structural diagram and a circuit diagram of a prior art switch device when it is in the neutral condition.
Figure 10B:
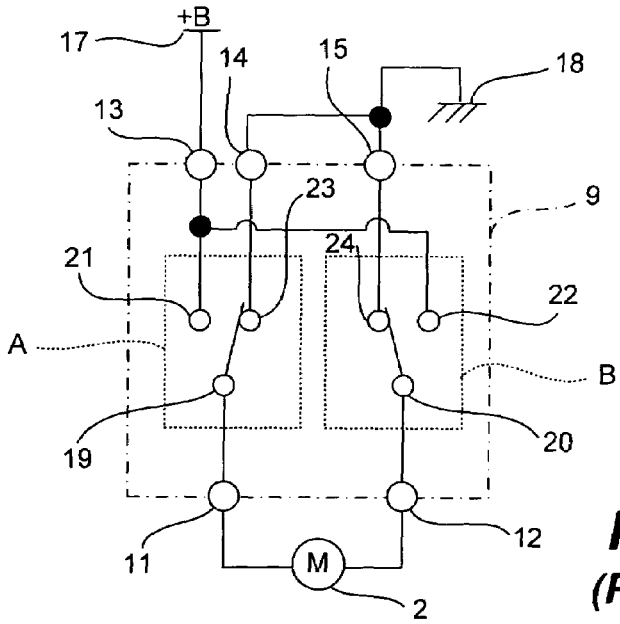
FIG. 10B (PRIOR ART)
Figure 11A:
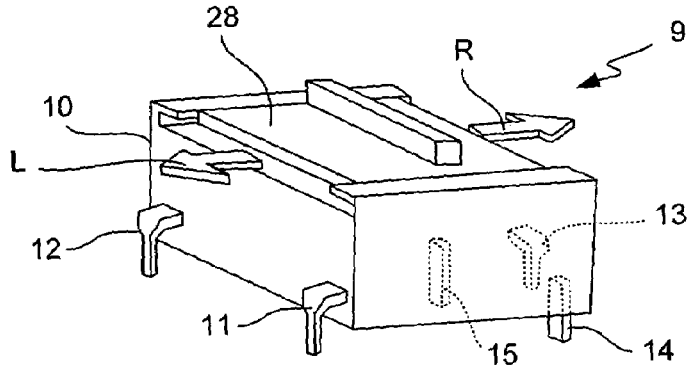
FIG. 11A (PRIOR ART)
FIGS. 11A, 11B, 11C and 11D, together referred to as FIG. 11, are respectively an external view of the switch unit of FIG. 10, a plan view of its slider, a sectional view taken along line 11C—11C of FIG. 11B and a sectional view taken along line 11D—11D of FIG. 11B.
Figure 11B:
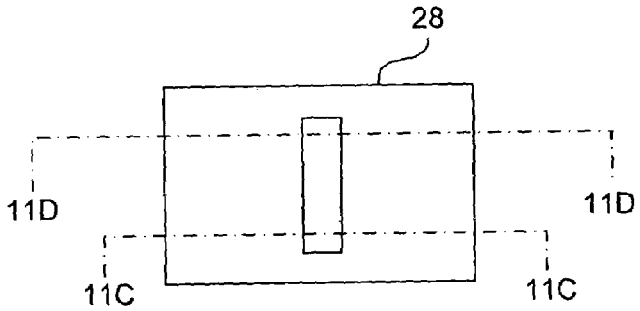
FIG. 11B (PRIOR ART)
Figure 11C:
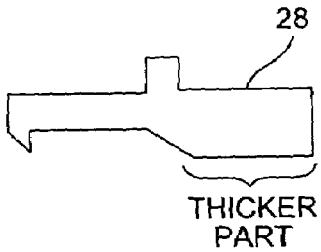
FIG. 11C (PRIOR ART)
Figure 11D:
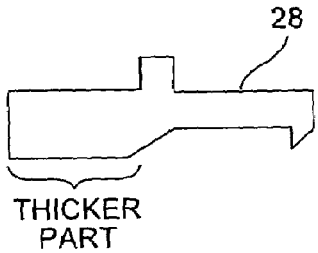
FIG. 11D (PRIOR ART)
Figure 12A:
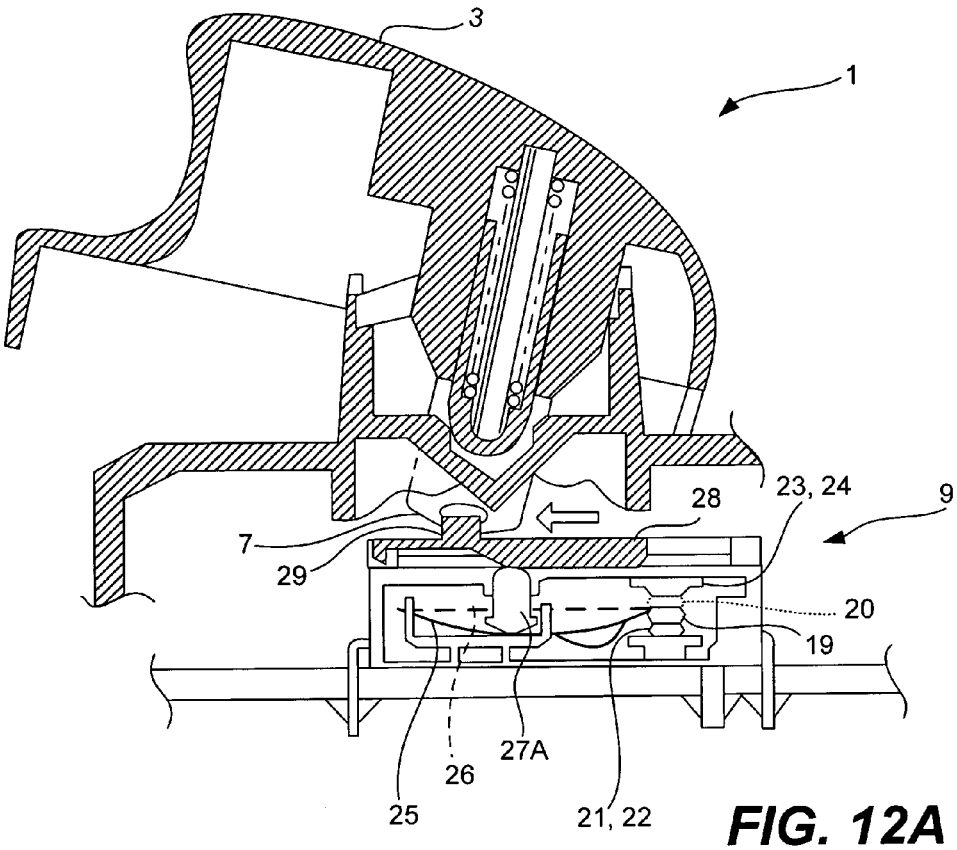
FIG. 12A (PRIOR ART)
FIGS. 12A and 12B, together referred to as FIG. 12 are respectively a structural diagram and a circuit diagram of the prior art switch device of FIG. 10 when it is in the UP condition.
Figure 12B:
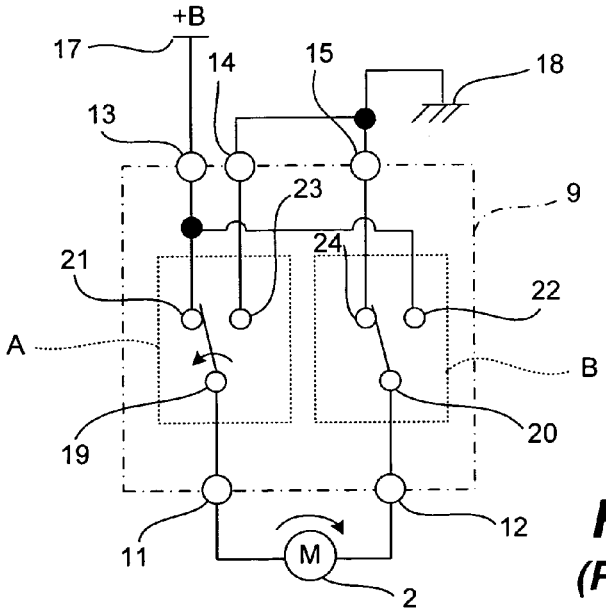
FIG. 12B (PRIOR ART)
Figure 13:
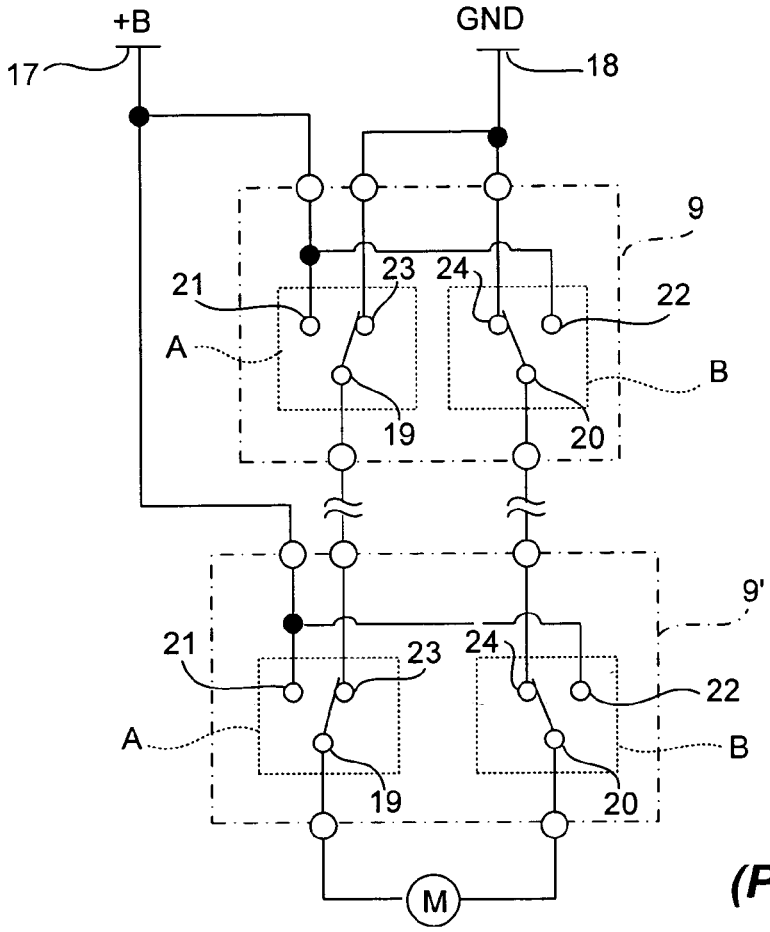
FIG. 13 (PRIOR ART)
FIG. 13 is a circuit diagram of another prior art switch device.
Figure 14:
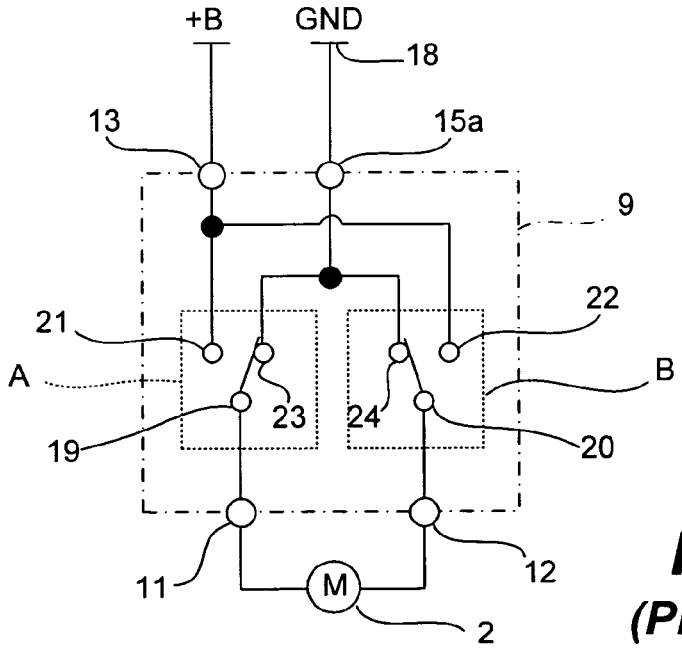
FIG. 14 (PRIOR ART)
FIG. 14 is a circuit diagram of still another prior art switch device having a total of four terminals.
Figure 15A:
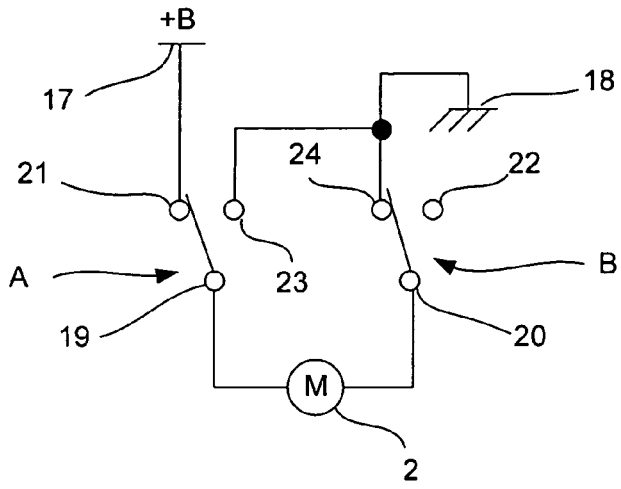
FIG. 15A (PRIOR ART)
FIGS. 15A, 15B and 15C, together referred to as FIG. 15, are circuit diagrams for explaining how contacts of a switch device may be damaged.
Figure 15B:
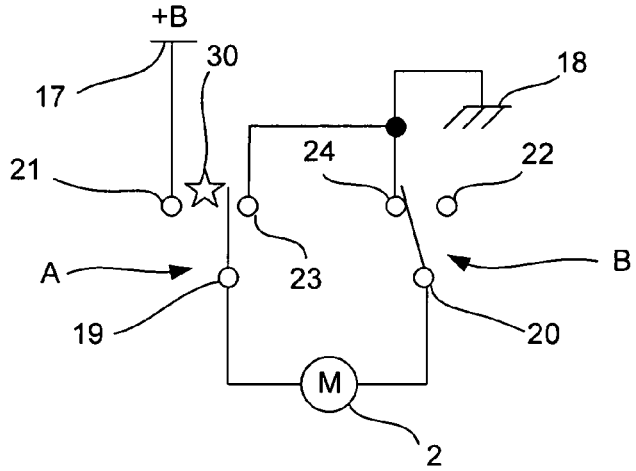
FIG. 15B (PRIOR ART)
Figure 15C:
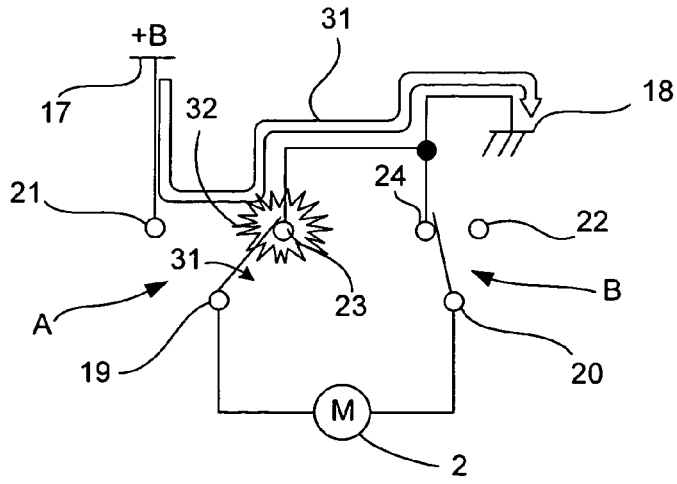
FIG. 15C (PRIOR ART)

FIGS. 2 and 3 illustrate these functions of the operating element 43. As shown in FIG. 2, the operating element 43 includes an operating means 43*a*, which is structured similarly to the slider 28 described above with reference to FIGS. 10–12 and slides to left or right with reference to FIG. 1 along the line 44 as the knob 3 (also described above with reference to FIGS. 10 and 12) is moved from the UP condition to the neutral condition to the DOWN condition or from the DOWN condition to the neutral condition to the UP condition.

As the operating means 43*a* is moved in one direction (such as to left with reference to FIG. 1) along the line 44, one of the mobile members of the first switch element 41 (say, for example, the mobile member 41*h*) is moved from its neutral position along the line 44 to left with reference to FIG. 1 such that the fixed electrodes 41*d* and 41*e* come to be in the closed condition and the other NC contact of the second switch element 42 (say, for example, the fixed contact 42*j*) comes to be in the open condition.

If the operating means 43*a* slides further to left, the fixed contact 42*j* comes to be in the closed condition and the function of driving the DC motor for opening the window is established. In other words, it may be said that these participating contacts 41*h*, 41*d*, 41*e* and 41*j* together form a motor driving switch group for the UP condition (or the UP switch group).

If the operating means 43*a* is moved in the opposite direction (that is, to right with reference to FIG. 1) along the line 44, the other of the mobile members of the first switch element 41 (that is, the mobile member 41*g*) moves from its neutral position along the line to right such that the fixed electrodes 41*a* and 41*b* come to be in the closed condition and the other NC contact of the second switch element 42 (that is, the fixed contact 42*i*) comes to be in the open condition.

If the operating means 43*a* slides further to right, the fixed contact 42*i* comes to be in the closed condition and the function of driving the DC motor for closing the window is established. In other words, it may be said that these participating contacts 41*g*, 41*a*, 41*b* and 41*i* together form a motor driving switch group for the DOWN condition (or the DOWN switch group).

For the convenience of description, operations of the UP switch group (as one of the switch groups defined above) are explained with reference to FIG. 3 wherein "X—X" and "Y—Y" indicate the sectional views taken respectively along the lines X—X and Y—Y shown in FIG. 2. Step 1 indicates the initial position in the neutral condition wherein the mobile member 41*h* of the first switch element 41 is located between the fixed electrodes 41*e* and 41*f* respectively at the center and on the right-hand side, keeping them in the closed condition. The push button 42*p* of the second switch element 42 is engaged in one of the indentations on the bottom surface of the operating means 43*a* and is in the raised condition. The metallic plate spring-like mobile member 42*d* is not bent downward and the moving contact 42*f* at the tip of this mobile member 42*d* is in the closed condition with the fixed contact 42*j*.

Immediately after the operating means 43*a* begins to move to left from the condition of Step 1 to approach the UP condition (Step 2), the mobile member 41*h* of the first switch element 41 remains at the position in Step 1, keeping the fixed electrodes 41*e* and 41*f* in the closed condition but the push button 42*p* of the second switch element 42 is out of the indentation on the bottom surface of the operating means 43*a* and contacts the thick portion of the operating means 43*a*. Since the push button 42*p* is thus being pressed downward, the mobile member 42*d* is bent downward and the closed condition between the moving contact 42*f* and the fixed contact 42*j* is released and they are now in the open condition.

As the UP condition progresses (Step 3), the mobile member 41*h* of the first switch element 41 is between the fixed electrodes 41*d* and 41*e* respectively on the right-hand side and at the center and keeps them in the closed condition while the fixed electrodes 41*e* and 41*f* are in the open condition. Since the push button 42*p* of the second switch element 42 is still at the thick portion of the operating means 43*a* and the mobile member 42*d* remains bent downward, the moving contact 42*f* at the tip of this mobile member 42*d* remains in the open condition with the fixed contact 42*j*.

As the UP condition progresses still further (Step 4), the mobile member 41*h* of the first switch element 41 continues to be between the fixed electrodes 41*d* and 41*e* to keep them in the closed condition. The push button 42*p* of the second switch element 42 engages in the other indentation on the bottom surface of the operating means 43*a* and is in the raised position. The mobile member 42*d* returns to its horizontal position such that the moving contact 42*f* at the tip of this mobile member 42*d* is in the closed condition with the fixed contact 42*j*.

Operations from the neutral condition to the DOWN condition is similar to those from the neutral condition to the UP condition described above and may be described by making the following replacements of symbols in the description of the operations from the neutral condition to the UP condition given above: 41*h*→41*g*, 41*d*→41*a*, 41*e*→41*b*, 41*f*→41*c*, 42*d*→42*c*, 42*j*→42*i*, 42*f*→42*e* and 42*p*→42*n*.

There are shown in FIG. 4 (comprised of FIGS. 4A, 4B, 4C and 4D) circuit diagrams of a system for rotating (in both positive and negative directions) and stopping a DC motor for opening and closing an automobile window by incorporating the switch device 40 embodying this invention. In FIG. 4, the +B line 17 serves as the power (voltage) source on the positive electrode side (or the +B line of the electrical system for a vehicle) and the grounding line 18 serves as the power (voltage) source on the negative electrode side (or the grounding line for the system) but they are distinguishable from prior art systems wherein the voltage applied through the +B line 17 is higher (say, a source voltage of 36V for a 42V electrical system) than that in the case of a 14V electrical system.

Figure 4A:
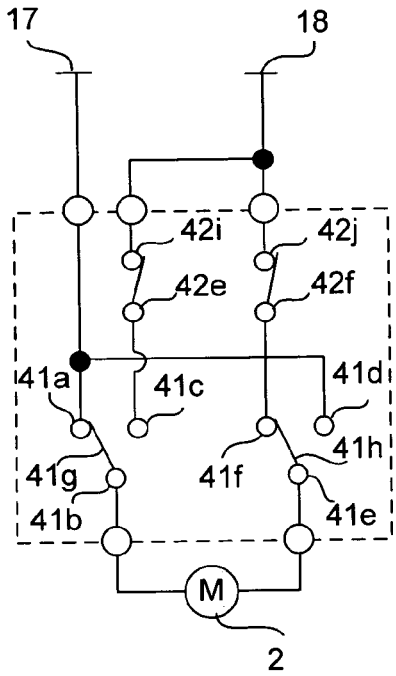
FIGS. 4A, 4B, 4C and 4D, together referred to as FIG. 4, are circuit diagrams of a system for rotating in both positive and negative directions and stopping a DC motor for opening and closing a window by incorporating the switch device of FIG. 1.
Figure 4B:
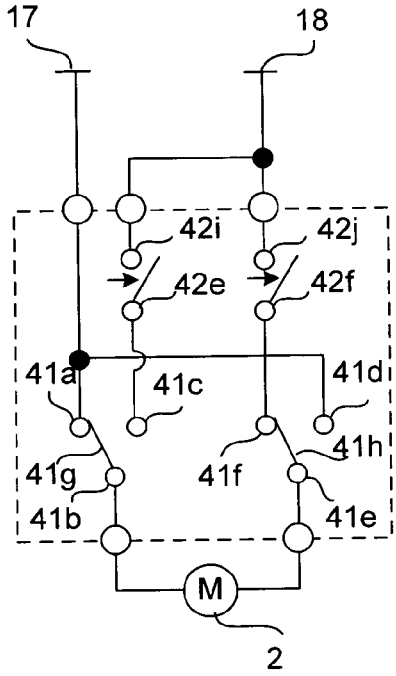
Figure 4C:
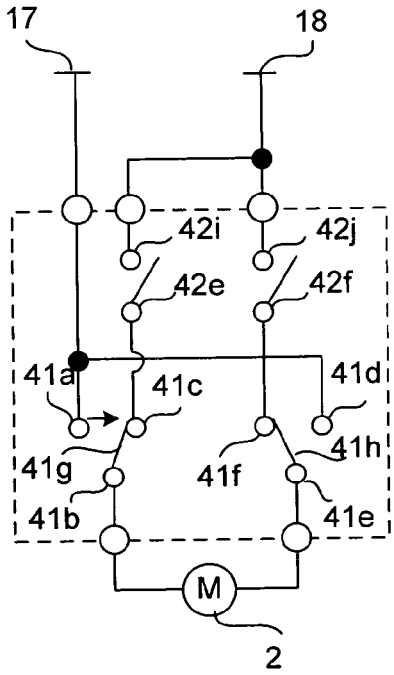
Figure 4D:
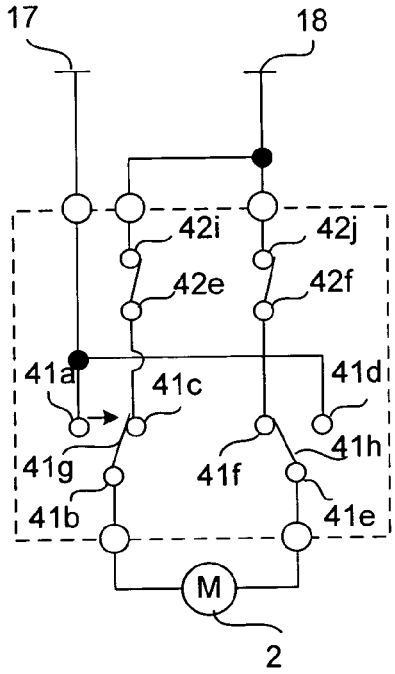

FIG. 4A shows the circuit when the system is in the DOWN condition, FIG. 4D shows the moment when the system has returned from the DOWN condition to the neutral condition and FIGS. 4B and 4C show the system at moments in between. When the system is in the DOWN condition, each of the contacts of the first and second switch elements 41 and 42 is in the condition of Step 4 shown in FIG. 3, that is, the mobile member 41*g* and the NO contact 41*a* of the first switch element 41 are in the closed condition, the mobile member 41*h* and the NC contact 41*f* are in the closed condition and the two NC contacts 42*i* and 42*j* of the second switch element 42 are in the closed condition. Thus, the voltage (such as +42V) of the +B line 17 is applied to one input terminal of the DC motor 2 while the ground voltage (0V) of the grounding line 18 is applied to the other input terminal of the DC motor 2, causing the DC motor 2 to rotate in the direction of opening the window.

If the system is released from the DOWN condition described above (say, by releasing the finger from the knob 3 referenced above), the circuit comes to appear as shown in FIG. 4B, that is, the two NC contacts 42*i* and 42*j* of the second switch element 42 comes to be in the open condition while the contacts of the first switch element 41 remain in the same conditions as before such that the DC motor 2 becomes disconnected from the grounding line 18.

Next, the condition as shown in FIG. 4C is reached wherein the closed condition between the mobile member 41 g and the NO contact 41*a* of the first switch element 41 is released and the mobile member 41*g* and the NC contact 41*c* come to be in the closed condition while the two NC contacts 42*i* and 42*j* of the second switch element remain in the open condition. Finally as the condition as shown in FIG. 4D is reached thereafter, the two NC contacts 42*i* and 42*j* of the second switch element 42 come to be in the closed condition and the both input terminals of the DC motor 2 become connected to the grounding line 18 such that the rotation of the DC motor 2 is stopped.

As explained above, the problem with prior art technology was that a large current flows through contacts when the DC motor is switched from the UP condition to the neutral condition or from the DOWN condition back to the neutral condition by switching contacts and that damages are frequently caused to the contacts due to such a large current flowing therethrough. According to the embodiment of the invention described above, the second switch element 42 is set in the open condition such that the flow route of such a large current is broken before or simultaneously as contacts of the first switch element 41 are switched. Thus, a large current is prevented from flowing through the contacts and damages thereto can be averted. Although two NC contacts are employed and this tends to increase the width, the switch device 40 need not be made larger to any significant degree and the response characteristics are not adversely affected since the contact gaps need not be increased. Since the second switch element 42 is realized with two NC contacts, furthermore, the space for the NO contacts may be utilized for increasing the contact gaps.

Figure 5:
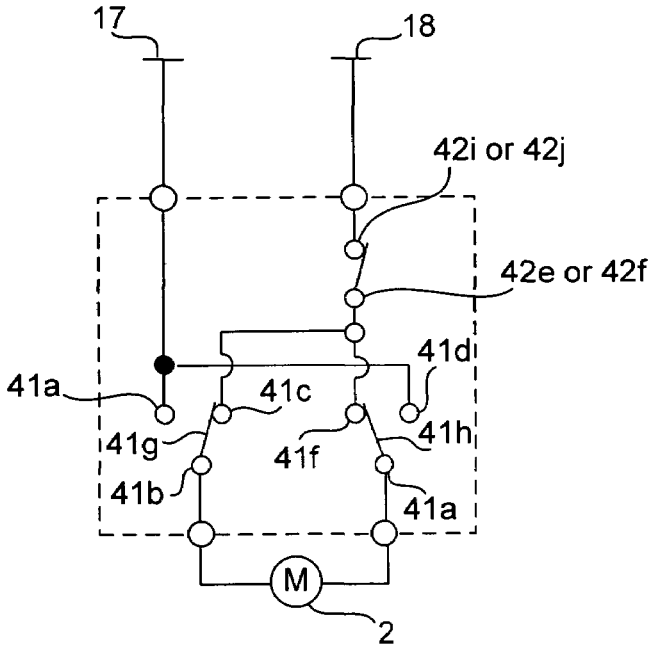
FIGS. 5–8 are circuit diagrams of various embodiments of this invention.

Although an embodiment has been described wherein the second switch element 42 was of the two-circuit, two-contact type, this may be realized with a one-circuit, one contact type, as shown in FIG. 5. The circuit shown in FIG. 5 is different from the one described above wherein the two NC contacts 41*c* and 41*f* of the first switch element are joined together within the switch and connected together through a single NC contact (42*i* or 42*j*) to the grounding line 18.

Figure 6:
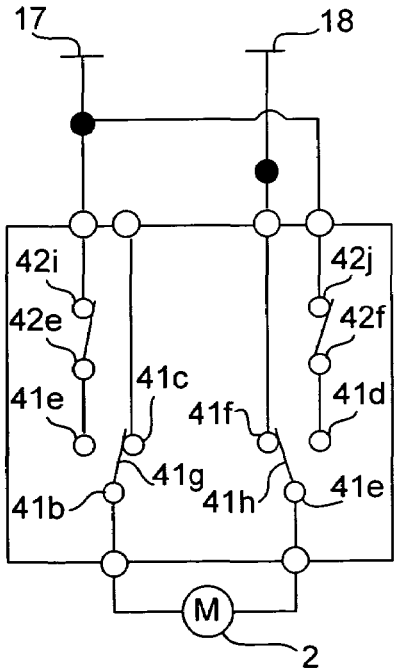

As a second example, a second switch element 42 of a two-circuit, two-contact type may be connected to the side of the positive voltage source, as shown in FIG. 6. The circuit shown in FIG. 6 is different wherein the mobile member 42*e* and NC contact 42*i* of the second switch element 42 are inserted between the NO contact 41*a* of the first switch element 41 and the +B line 17 and the other mobile member 42*f* and the other NC contact 42*j* of the second switch element 42 are inserted between the other NO contact 41*d* of the first switch element and the +B line 17.

Figure 7:
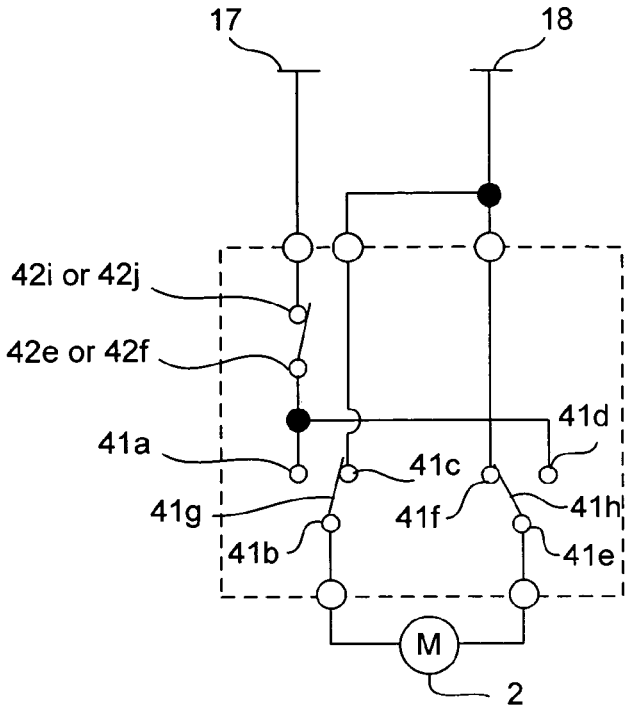

The second switch element 42 of FIG. 6 may be formed as a one-circuit, one contact type, as shown in FIG. 7. The circuit shown in FIG. 7 is different wherein the two NC contacts 41*c* and 41*f* of the first switch element 41 are joined together within the switch and connected together through a single NC contact (42*i* or 42*j*) to the +B line 17.

When either of the circuits as shown in FIGS. 6 and 7 is used, the NC contact 42*i* or 42*j* is set in the open condition before either of the NO contacts 41*a* and 41*d* of the first switch element 41 is switched from the closed condition to the open condition. Since the route for a large current is thereby broken such that damages to the contacts in the first switch element 41 can be prevented and there is no need to increase the contact gaps, the size of the switch device does not increase and its response characteristics are not adversely affected.

Figure 8:
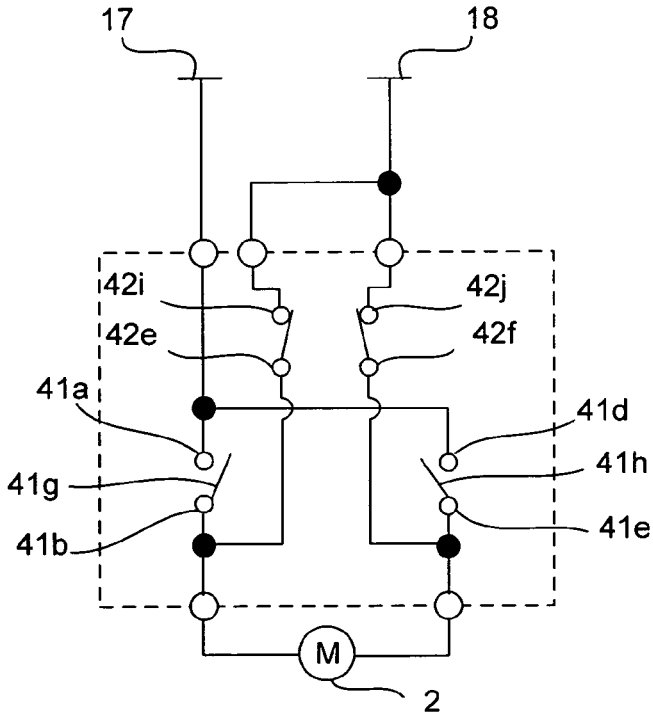

As a further variation, the first switch element 41 may be of a four-circuit, four-contact type, as shown in FIG. 8. The circuit shown in FIG. 8 is different wherein the two NC contacts 41*c* and 41*f* of the first switch element 41 are dispensed with and wherein the input terminals of the DC motor 2 are made selectively connectable to the +B line 17 through the two NO contacts 41*a* and 41*d* of the first switch element 41 and to the grounding line 18 through the two NC contacts 42*i* and 42*j* of the second switch unit 42. In order to prevent damages to the NO contacts 41*a* and 41*d* of the first switch element 41, the NC contacts 42*i* and 42*j* of the second switch element 42 connected to these NO contacts may be set in the open condition.

Figure 9:
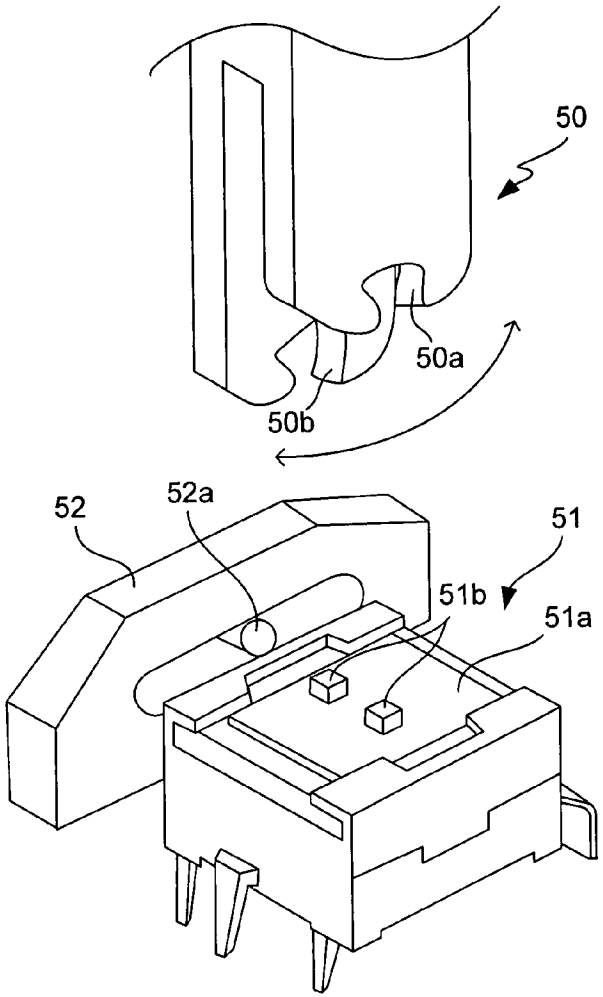
FIG. 9 is an external view of an embodiment wherein the first and second switch elements are formed as separate units.

In all of the variations described above, the first and second switch elements 41 and 42 were represented as forming a single unit together but this is not intended to limit the scope of this invention. FIG. 9 shows an example of this invention having a first unit 51 containing the first switch element 41 and a second unit containing the second switch element 42, arranged next to each other. Numeral 50 indicates a knob, which is an equivalent of the knob 3 described above with reference to FIGS. 10 and 12, provided with two indentations 50*a* and 50*b* adapted to engage switch operating parts of the first and second units 51 and 52, respectively (a protrusion 51*b* on a slider 51*b* of the first unit 51 and a protrusion 52*a* for the operation of the second unit 52).

As should be clear from the description of the embodiments of the invention, the route of the instantaneous flow of a large current can be broken by opening the contacts of the second switch element at an appropriate timing such that damages to the contacts in the first switch element can be prevented. Thus, the inconvenience of prior art technology when a high source voltage such as a 42V electrical system is used on a vehicle can be eliminated. Since the new technology according to this invention does not required any increase in the contact gaps, the switch unit does not become large and the response characteristics are not adversely affected.

What is claimed is:

1. A switch device for rotating and stopping a DC motor, said switch device comprising:

a first switch element having two moving contacts, two normally open NO contacts and two normally closed NC contacts;

a second switch element having at least one normally closed NC contact; and an operating element for connecting said two moving contacts individually to input terminals of said DC motor, connecting said two NO contacts to a higher voltage source line, connecting each of said two NC contacts of said first switch element to a lower voltage source line at a lower voltage than said higher voltage source line each through one of said at least one NC contact of said second switch element, and maintaining said at least one NC contact of said second switch element in an open condition during a period from when one of said NO contacts begins to change from a closed condition to an open condition until corresponding one of said NC contacts of said first switch element finishes changing from an open condition to a closed condition.

2. The switch device of claim 1 wherein said second switch element has only one normally closed NC contact and said operating element serves to connect each of said two NC contacts of said first switch element to said lower voltage source line through said only one NC contact of said second switch element and to maintain said only one NC contact of said second switch element in an open condition during said period.

3. The switch device of claim 1 wherein said second switch element has two normally closed NC contacts and said operating element serves to connect each of said two NC contacts of said first switch element to said lower voltage source line through corresponding one of said two NC contacts of said second switch element and to maintain both of said two NC contacts of said second switch element in an open condition during said period.

4. A switch device for rotating and stopping a DC motor, said switch device comprising:

a first switch element having two moving contacts, two normally open NO contacts and two normally closed NC contacts;

a second switch element having at least one normally closed NC contact; and an operating element for connecting said two moving contacts individually to input terminals of said DC motor, connecting said two NC contacts to a lower voltage source line, connecting each of said two NO contacts of said first switch element to a higher voltage source line at a higher voltage than said lower voltage source line through one of said at least one NC contact of said second switch element, and, before either one of said NO contacts of said first switch element changes from a closed condition to an open condition, allowing the one of said at least one normally closed NC contact of said second switch element connected to said one NO contact to be in an open condition.

5. The switch device of claim 4 wherein said second switch element has only one normally closed NC contact and said operating element serves to connect each of said two NC contacts of said first switch element to said higher voltage source line through said only one NC contact of said second switch element and, before either one of said NO contacts of said first switch element changes from a closed condition to an open condition, to allow said only one NC contact of said second switch element to be in an open condition.

6. The switch device of claim 4 wherein said second switch element has only one normally closed NC contact and said operating element serves to connect each of said two NC contacts of said first switch element to said higher voltage source line through corresponding one of said two NC contacts of said second switch element and, before either one of said NO contacts of said first switch element changes from a closed condition to an open condition, to allow the one of said two NC contacts of said second switch element connected to the either one NO contact to be in an open condition.

7. A switch device for rotating and stopping a DC motor, said switch device comprising:

a first switch element having two normally open NO contacts;

a second switch element having two normally closed NC contacts; and an operating element for connecting two input terminals of said DC motor to a higher voltage line each through a corresponding one of said two NO contacts of said first switch element, connecting said two input terminals of said DC motor to a lower voltage source line at a lower voltage than said higher voltage each through a corresponding one of said two NC contacts of said second switch element and, before either one of said NO contacts of said first switch element changes from an open condition to a closed condition, allowing the one of said NC contacts of said second switch element connected to said one NO contact to be in an open condition.

* * * * *